US009716334B1

(12) United States Patent
Thompson

(10) Patent No.: US 9,716,334 B1
(45) Date of Patent: Jul. 25, 2017

(54) ELECTRICAL CONNECTOR APPARATUS AND ASSEMBLY METHOD

(71) Applicant: California Eastern Laboratories, Inc., Santa Clara, CA (US)

(72) Inventor: Aren Mejchar Thompson, Lake Zurich, IL (US)

(73) Assignee: California Eastern Laboratories, Inc., Santa Clara, CA (US)

( * ) Notice: Subject to any disclaimer, the term of this patent is extended or adjusted under 35 U.S.C. 154(b) by 0 days.

(21) Appl. No.: 15/428,026

(22) Filed: Feb. 8, 2017

(51) Int. Cl.

| | |
|---|---|
| ***H01R 9/03*** | (2006.01) |
| ***H01R 13/422*** | (2006.01) |
| ***H01R 13/04*** | (2006.01) |
| ***H01R 43/20*** | (2006.01) |
| ***H01R 43/18*** | (2006.01) |
| *H01R 13/6581* | (2011.01) |
| *H01R 12/00* | (2006.01) |

(52) U.S. Cl.
CPC ..... *H01R 13/422* (2013.01); *H01R 13/04* (2013.01); *H01R 43/18* (2013.01); *H01R 43/205* (2013.01); *H01R 12/00* (2013.01); *H01R 13/6581* (2013.01)

(58) Field of Classification Search
CPC ..... H01R 13/422; H01R 43/18; H01R 13/04; H01R 12/00; H01R 13/6581
USPC ..... 439/658, 84, 752, 650, 695, 76.1, 78, 83
See application file for complete search history.

(56) References Cited

U.S. PATENT DOCUMENTS 3,391,384 A 7/1968 Hughes
5,556,308 A 9/1996 Brown et al.
6,062,916 A * 5/2000 Gladd ..... H01R 9/223 439/751
7,303,416 B1 * 12/2007 Liao ..... H01R 13/633 439/173
7,553,171 B2 * 6/2009 Wang ..... H01R 13/4226 439/106
8,480,412 B2 * 7/2013 Belanger, Jr. ..... H01R 12/7064 439/751
8,876,541 B1 * 11/2014 Wu ..... H01R 27/00 439/173

(Continued)

OTHER PUBLICATIONS

"Heyco PCB Contacts", http://www.heyco.com/Power_Components/pdf/8-38_115.pdf, retrieved Aug. 7, 2016.

*Primary Examiner* — Tho D Ta
*Assistant Examiner* — Nader Alhawamdeh
(74) *Attorney, Agent, or Firm* — Spilman Thomas & Battle, PLLC; Eric D. Ruka

(57) ABSTRACT

An electrical connector includes, in an embodiment, an electrically-conductive blade and a receiving body allowing a secure connection through a twist-lock arrangement. The electrically-conductive blade may include a neck and one or more shoulders that have a shoulder-span. The receiving body may include a hole to receive at least a portion of the blade, the hole including a length that is less than the shoulder-span of the one or more shoulders of the blade, and may further include a bulging portion to allow rotation of the blade when the blade extends through the hole of the receiving body such that the neck of the blade is aligned with the bulging portion, the bulging portion including at least one stop to limit the rotation of the blade. An assembly method describes, in an embodiment, a method of assembling the aforementioned electrical connector.

27 Claims, 16 Drawing Sheets

(56) References Cited

U.S. PATENT DOCUMENTS

| | | | | |
|---|---|---|---|---|
| 8,936,478 | B2 * | 1/2015 | Choi | H01R 13/447<br>439/172 |
| 9,350,101 | B2 | 5/2016 | Taylor | |
| 9,640,934 | B2 * | 5/2017 | Hoffmeyer | H01R 43/205 |
| 2017/0155204 | * | 6/2017 | Guo | H01R 13/04 |

* cited by examiner

ELECTRICAL CONNECTOR APPARATUS AND ASSEMBLY METHOD

FIELD OF THE INVENTION

The invention relates to an electrical connector apparatus and method, and more particularly to an electrical connector apparatus and assembly method in which the securing of one or more electrically-conductive blades of the electrical connector involves a rotatable connection.

BACKGROUND OF THE INVENTION

An electrical connector is a device that may include one or more electrically-conductive blades secured to another body, such as a plastic housing. An electrical connector may be subject to safety testing to ensure its structural integrity. To that end, the blades are often molded to the housing. However, such an attachment mechanism may be more expensive and time-consuming than securing the blade to another part of the electrical connector, such as a printed circuit board (PCB) or other body.

Thus, there may be a need for an electrical connector or part thereof having a more efficient blade attachment structure and mechanism that yet sufficiently secures each blade and meets applicable safety standards.

SUMMARY OF THE INVENTION

In an embodiment, an electrical connector includes an electrically-conductive blade and a receiving body. The electrically-conductive blade includes in the embodiment includes: a neck and one or more shoulders, the one or more shoulders having a shoulder-span. The receiving body may include a hole to receive at least a portion of the blade, the hole including: a length that is less than the shoulder-span of the one or more shoulders of the blade; and a bulging portion to allow rotation of the blade when the blade extends through the hole of the receiving body such that the neck of the blade is aligned with the bulging portion, the bulging portion including at least one stop to limit the rotation of the blade.

In another embodiment, an electrical connector assembly method includes: inserting an electrically-conductive blade at least partially through a hole of a receiving body until a neck of the blade is aligned with the hole; rotating the blade such that the neck of the blade rotates within the receiving body hole until the neck contacts at least one stop of the receiving body hole and is thereby stopped from further rotation; and securing the blade to the receiving body.

Other embodiments, which may include one or more parts of the aforementioned systems and methods or other parts, are also contemplated, and may thus have a broader or different scope than the aforementioned systems and methods. Thus, the embodiments in this Summary of the Invention are mere examples, and are not intended to limit or define the scope of the invention or claims.

BRIEF DESCRIPTION OF THE DRAWINGS

The accompanying drawings, wherein like reference numerals are employed to designate like components, are included to provide a further understanding of electrical connector apparatuses and methods is incorporated in and constitutes a part of this specification, and illustrates embodiments of electrical connector apparatuses and methods therefore that together with the description serve to explain the principles of electrical connector apparatuses and methods therefore.

Various other objects, features and advantages of the invention will be readily apparent according to the following description exemplified by the drawings, which are shown by way of example only, wherein.

DETAILED DESCRIPTION

Reference will now be made to embodiments of electrical connector apparatuses and methods, examples of which are illustrated in the accompanying drawings. Details, features, and advantages of electrical connector apparatuses and methods therefore will become further apparent in the following detailed description of embodiments thereof.

It is to be understood that the specific apparatuses and methods described in the following specification are simply exemplary embodiments of the present invention and are not to be considered as limiting.

Any reference in the specification to "one embodiment," "a certain embodiment," or a similar reference to an embodiment is intended to indicate that a particular feature, structure or characteristic described in connection with the embodiment is included in at least one embodiment of the invention. The appearances of such terms in various places in the specification do not necessarily all refer to the same embodiment. References to "or" are furthermore intended as inclusive, so "or" may indicate one or another of the ored terms or more than one ored term.

As described herein, embodiments of the electrical connector apparatuses and methods provide an electrical connector that has electrically-conductive blades that may be sufficiently secured cost-effectively and more quickly as compared to conventional means.

Figure 1:
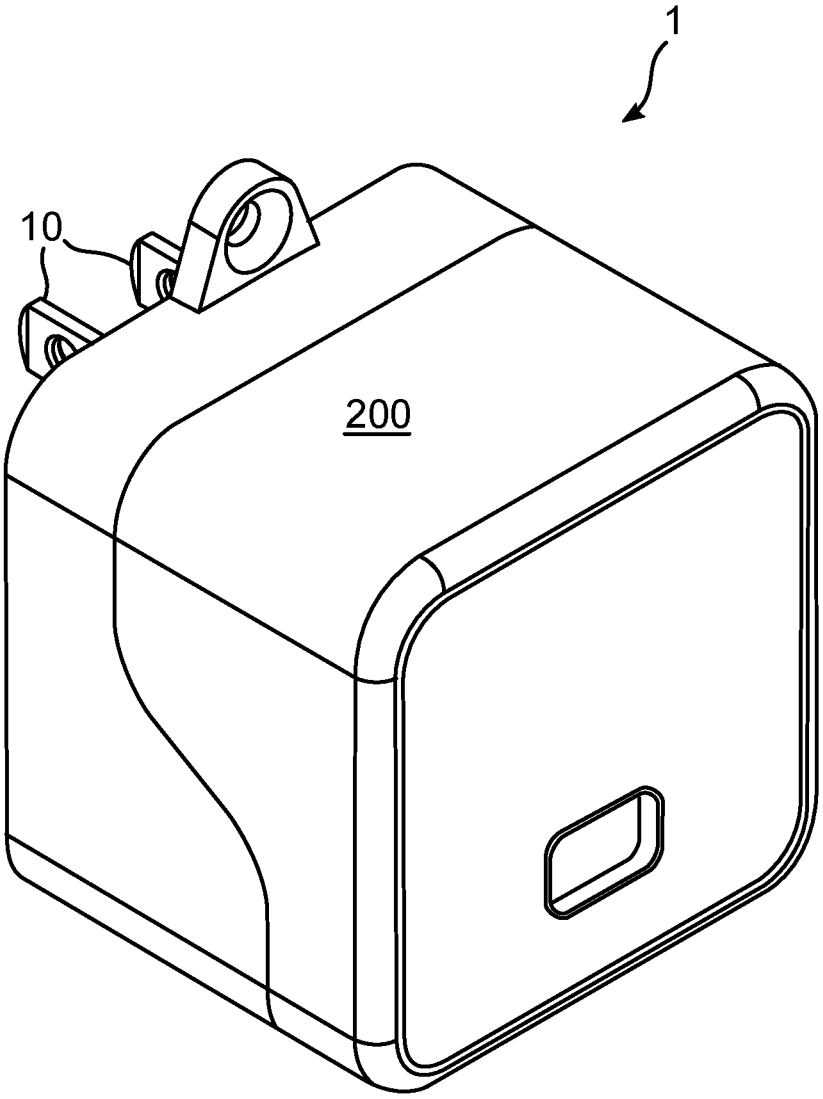
FIG. 1 illustrates a perspective view of an electrical connector, in accordance with an embodiment.

FIG. 1 illustrates a perspective view of an electrical connector 1, in accordance with one embodiment. The electrical connector 1 may include one or more electrically-conductive blades 10 ("electrically-conductive blades 10" are also referred to herein as "blades 10"), such as two blades 10 in one embodiment. The electrical connector 1 may also include a receiving body (shown in FIGS. 3-10 and 12-13 at reference number 100, and in FIG. 15 at reference number 600) and a housing 200 that may partially or fully enclose the receiving body. In one embodiment, the electrical connector may not include the housing 200.

Figure 2:
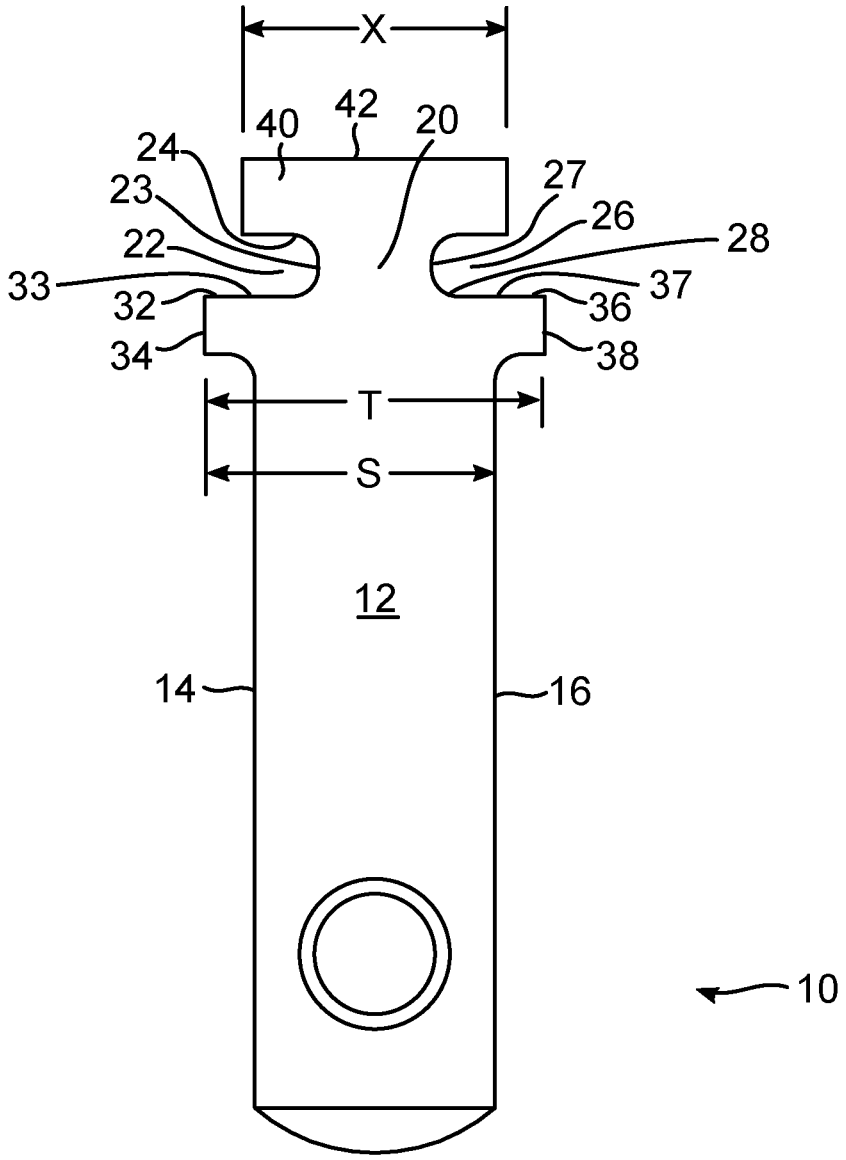
FIG. 2 illustrates a front view of an electrically-conductive blade for an electrical connector, in accordance with one embodiment.

FIG. 2 illustrates a front view of an electrically-conductive blade 10, at least one of which may be included in an electrical connector 1, in accordance with embodiments. Each blade 10 may be shaped as described in embodiments herein to allow for a more secure attachment to the receiving body 100 of the electrical connector 1. Referring to one blade 10, and recognizing that the elements described herein apply to two (or more) blades 10 in an embodiment (though the dimensions of the blades 10 may be different), the blade 10 may be an elongated body made of a material that is conductive of electricity and may fit into a hole of an electrical outlet. In an embodiment, the blade 10 may be sized for a Type A plug, being generally flat with a face 12 that is wide compared its first side 14 and second side 16, or may be otherwise sized in different embodiments.

The blade 10 may include a neck 20. The neck 20 may be a portion of the blade 10 having a lesser width that surrounding portions. The neck 20 may thus be adjacent to one or more, such as two in an embodiment, notches that define the neck 20 such that the notch or notches together form at least part of the border of the neck 20. For example, the blade 10 may include the neck 20 such that the blade 10 is notched in one or both its opposing sides 14 and 16. In an embodiment, the neck 20 is defined by two notches, a first notch 22 in the first side 14 of the blade 10 and a second notch 26 in the opposing, second side 16 of the blade 10. In an embodiment, the first notch 22 may include a base 23 that is curved, and thus the base of its interior wall 24 may be curved, and the second notch 26 may include a base 27 that is curved, and thus the base of its interior wall 28 may be curved. Other portions of the first notch 22 and second notch 26 may not be curved if desired. Having those bases 23 and 27 be curved, such as each with a radius of curvature over at least a portion of the base if desired, may cause less wear in a stamping tool during a blade-stamping production process as compared to a stamping process in which those bases have sharp corners. Additionally, curved bases may lessen or prevent the stress concentrations that would be created in a base with sharp corners.

The blade 10 may include one or more shoulders. In an embodiment, the blade 10 has a first shoulder 32 (in which case the blade 10 may not have second shoulder 36 and the neck 20 may have an edge adjacent to, and possibly coincident with, the first side 14 or second side 16 of the blade 10, such as described below with respect to the blade 510 of FIG. 14), and in another embodiment the blade 10 has two shoulders 32 and 36. The one shoulder 32 or two shoulders 32 and 36 may have a shoulder-span that is the width of blade 10 at the one shoulder 32 only or, if applicable, the width at the two shoulders 32 and 36. Thus, in an embodiment in which the blade 10 has only one shoulder 32, the shoulder-span S is the distance between the end 34 of the first shoulder 32 and the opposing second side 16 of the blade 10. In an embodiment in which the blade 10 has two shoulders 32 and 36, the shoulder-span T is the distance between the end 34 of the first shoulder 32 and the end 38 of the second shoulder 36.

If desired and as shown, for example, in FIG. 2, the first shoulder 32 may extend from the first side 14 of the blade 10, and the second shoulder 36 may extend from the second side 16 of the blade 10. However, in another embodiment, the first shoulder 32 may not extend past the first side 14 of the blade 10 and may have its end 34 be coincident with the first side 14, and/or the second shoulder 36 may not extend past the second side 16 of the blade 10 and may have its end 38 be coincident with the second side 16. In an embodiment, the neck 20 of the blade 10 is adjacent to the one or more shoulders 32 and 36, and thus to the one or more notches 22 and 26, of the blade 10. For example, the neck 20 and first notch 22 may be adjacent to the first shoulder 32, and the neck 20 and second notch 26 may be adjacent to the second shoulder 36 such as shown in FIG. 2. In an embodiment, the first notch 22 is adjacent to the first shoulder 32 to the extent that the interior wall 24 of the first notch 22 is coincident with a wall 33 of the first shoulder 32, and the second notch 26 is adjacent to the second shoulder 36 to the extent that the interior wall 28 of the second notch 26 is coincident with a wall 37 of the second shoulder 36.

The blade 10 may also include an end portion 40 that is adjacent to the neck 20 and which extends from an end 42 of the blade 10 to the neck 20. The end portion 40 may have a span X that is less than the length L of the hole 110 of the receiving body 100 described below to allow the end portion 40 to be inserted through the hole 110.

Figure 3:
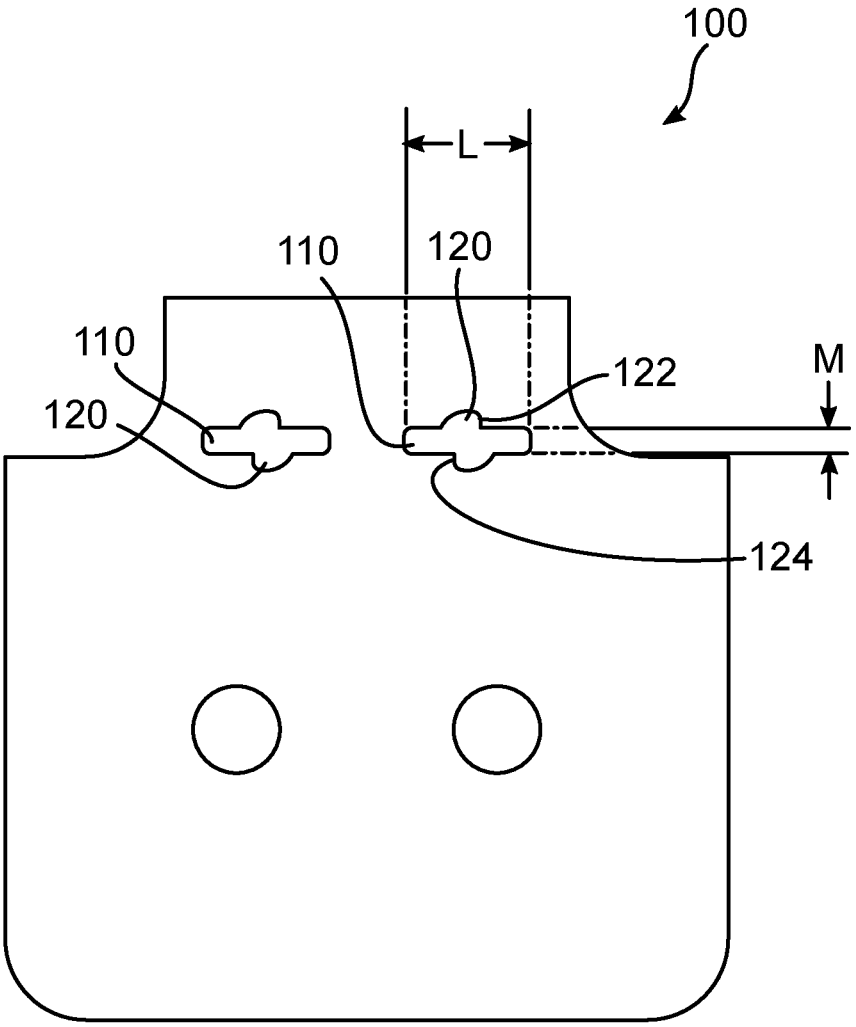
FIGS. 3-4 illustrate a top and bottom view, respectively, of a receiving body of an electrical connector, in accordance with an embodiment.
Figure 4:
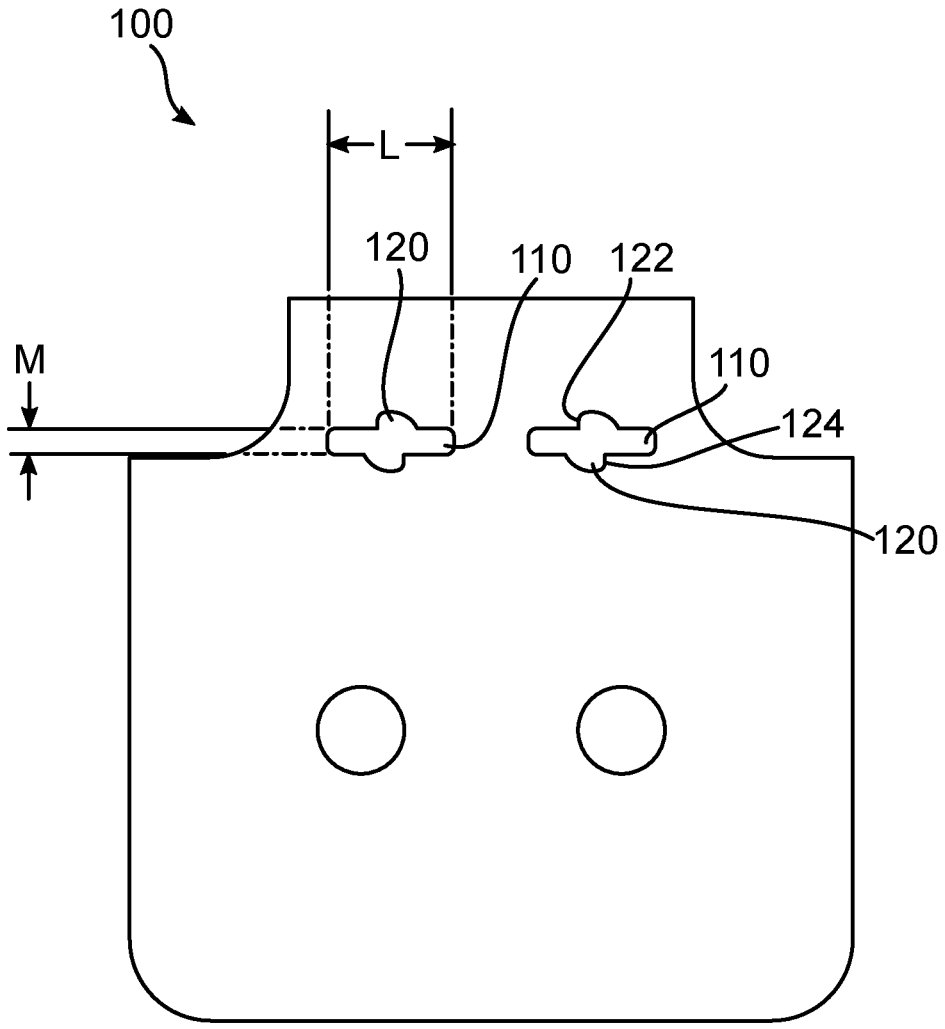
Figure 12:
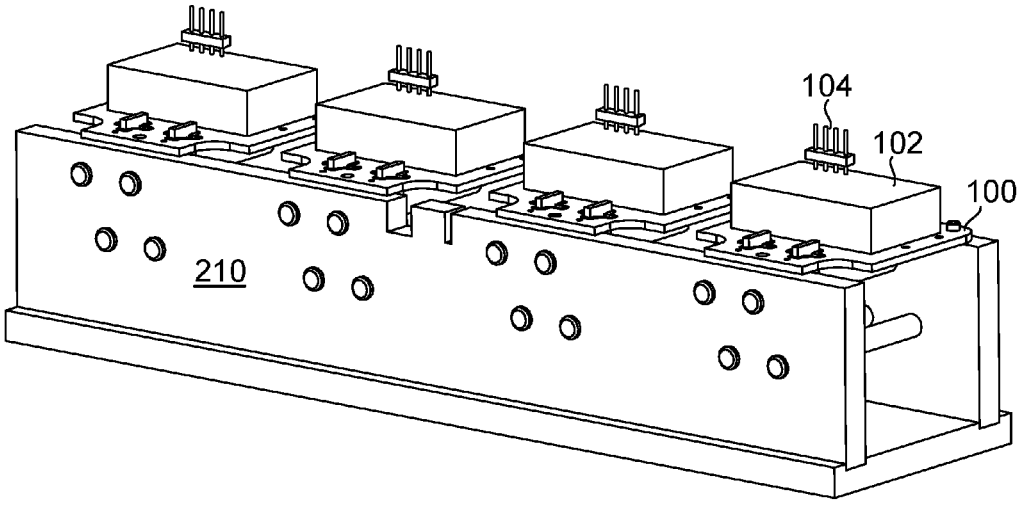
FIG. 12 illustrates a perspective view of electrical connectors set on blade fixtures, in accordance with an embodiment.

FIGS. 3 and 4 illustrate a top and bottom view, respectively, of an embodiment of a receiving body 100. The receiving body 100 of the electrical connector 1 may be a body that has secured thereto the one or more electrically-conductive blades 10. In embodiments, the receiving body 100 may be or at least include a printed circuit board (PCB). If desired and as shown in FIG. 12, in which receiving body 100 embodiments are shown set on a blade fixture 210 as described below with respect to FIGS. 9-10, the receiving body 100 may be or include a PCB and also a power supply 102 and 4-pin connector or other multi-pin connector 104.

The receiving body 100 may receive at least a portion of each blade 10 in a different of one or more holes 110 during assembly of the electrical connector 1. Referring to one hole 110, and recognizing that the elements described herein regarding the one hole 110 apply to both holes 110 (though the dimensions of the holes 110 may be different to accommodate an embodiment in which the dimensions of the blades 10 are different), the hole 110 may be at least partially elongated with a length L that is less than, depending on the embodiment, the shoulder-span S or T of the shoulder 32 or shoulders 32, 36, respectively, of the blade 10. The length L may also be greater than the span X of the end portion 40 of the blade 10. The hole 110 may also have a width M that is wider than the blade width (which may be the dimension transverse to the face 12 of the blade 10 and thus the width of the sides 14 and 16 of the blade 10). Thus, the end portion 40 of the blade 10 may fit into the hole 110 of the receiving body 100. The blade 10 may accordingly be inserted at least partially into the hole 110 of the receiving body 100 starting at its end portion 40. However, because the shoulder 32 (or shoulders 32 and 36) of the blade 10 has a shoulder-span S (or T) that is greater than the width M of the receiving body 100 hole 110, the shoulder 32 (or shoulders 32 and 36) may not be able to extend into the receiving body 100 hole 110. Thus, the blade 10 may only be able to be inserted until the shoulder 32 (or shoulders 32 and 36) reaches, and thus contacts and is blocked from further insertion through the hole 110 by, at least a portion of the receiving body 100. An embodiment of this configuration and process is discussed below with respect to FIGS. 5-6.

Figure 3A:
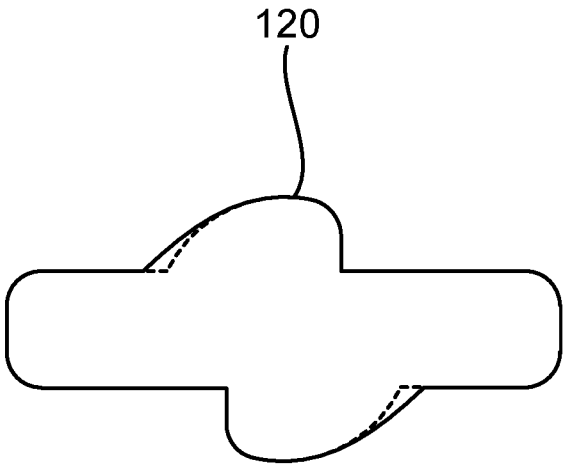
FIG. 3A illustrates a top view of receiving body hole of an electrical connector in which the bulging portion of the hole has an at least partially oval shape, in accordance with one embodiment.

The hole 110 of the receiving body 100 may also include a bulging portion 120, which may in an embodiment be centrally located along the length L of the hole 110. The bulging portion 120 may be sized and shaped to allow rotation of the blade 10 when the blade 10 is inserted into and extends through the receiving body 100 hole 110 such that the neck 20 of the blade 10 is aligned with the bulging portion 120. That alignment may be, in an embodiment, when, as described above, the blade 10 has been inserted until the shoulder 32 (or shoulders 32 and 36) blocks the blade 10 from further insertion. In embodiments, the bulging portion 120 is at least partially curved with a size and shape that allow the neck 20 of the blade 10, when aligned with the bulging portion 120, to rotate therein. For example, the bulging portion 120 may be at least partially curved such that the bulging portion 120 is at least partially circular with a diameter sufficient to allow the neck 20 of the blade 10, when aligned with the bulging portion 120, to rotate therein. In another example, the bulging portion 120 may be at least partially curved with an at least partial oval shape. An embodiment of such a bulging portion 120 shape that is at least partially oval is shown in FIG. 3A (and compared to a partially circular shape provided by dashed lines 121). An at least partial oval shape may allow a ramp-in for the engagement of the neck 20 with the bulging portion 120 such that as the neck 20 is initially rotated within the bulging portion 120, the neck 20 may not touch the receiving body 100. However, as the neck 20 further rotates, the respective bases 23 and 27 of the interior walls 24 and 28 of the notches 22 and 26 that define the neck 20 may contact the perimeter of the bulging portion 120, and thus contact the receiving body 100. Thus, the initial force to turn the neck 20 within the oval-shaped bulging portion 120 may be low, but may increase as the neck 20 rotates and contacts the perimeter of the bulging portion 120, creating friction. That contact may occur near the end of the rotation of the neck 20, such as near the position in which the blade 10 (and thus the neck 20) contacts the stop 122 (or stops 122 and 124) as described below. The bulging portion 120 may be otherwise partially curved.

The bulging portion 120 may also include at least one stop 122 and may include a second stop 124. The stop 122 (or stops 122 and 124 together) may limit the rotation of the blade 10 by blocking the blade 10 from further rotation after some degree of rotation, such as 90 degrees in an embodiment. The stop 122 (or stops 122 and 124) may serve to align the blade 10 in a set orientation to be secured to the receiving body 100, such as via solder as described below.

Figure 5:
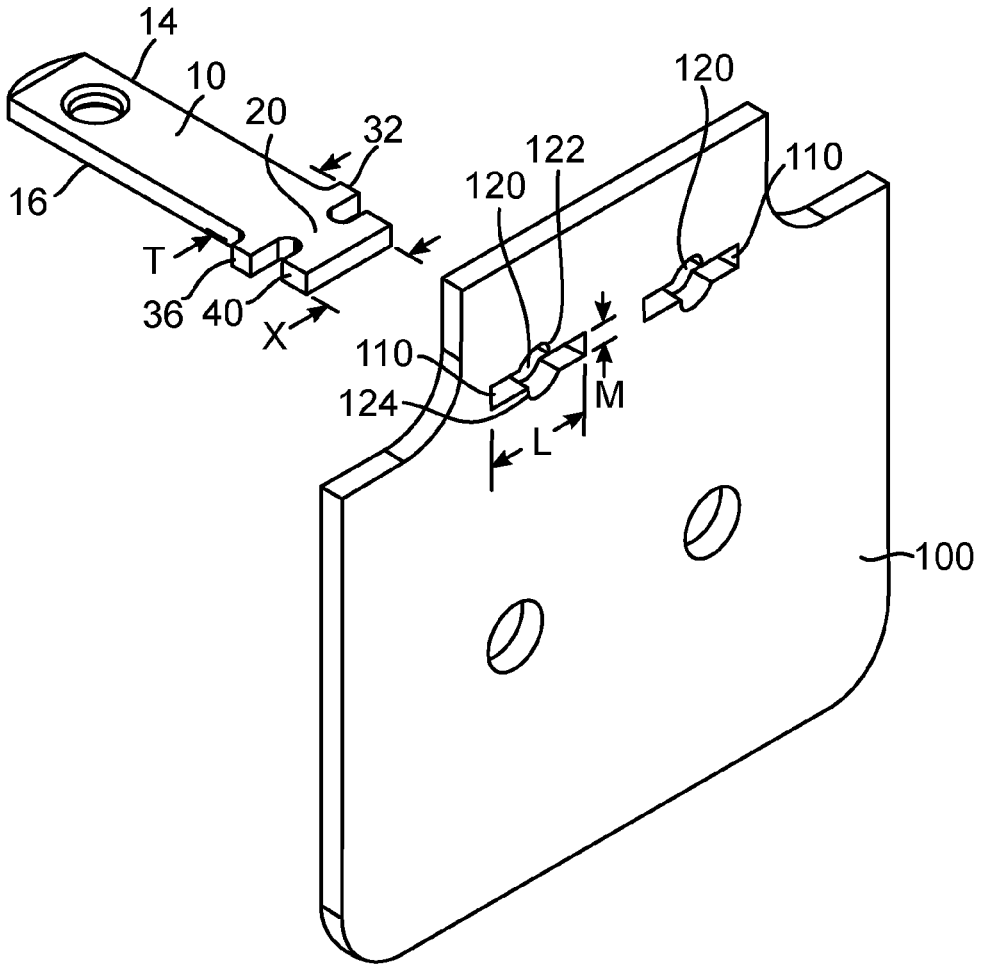
FIG. 5 illustrates a perspective view of an electrically-conductive blade and a receiving body of an electrical connector, unassembled, in accordance with one embodiment.
Figure 6:
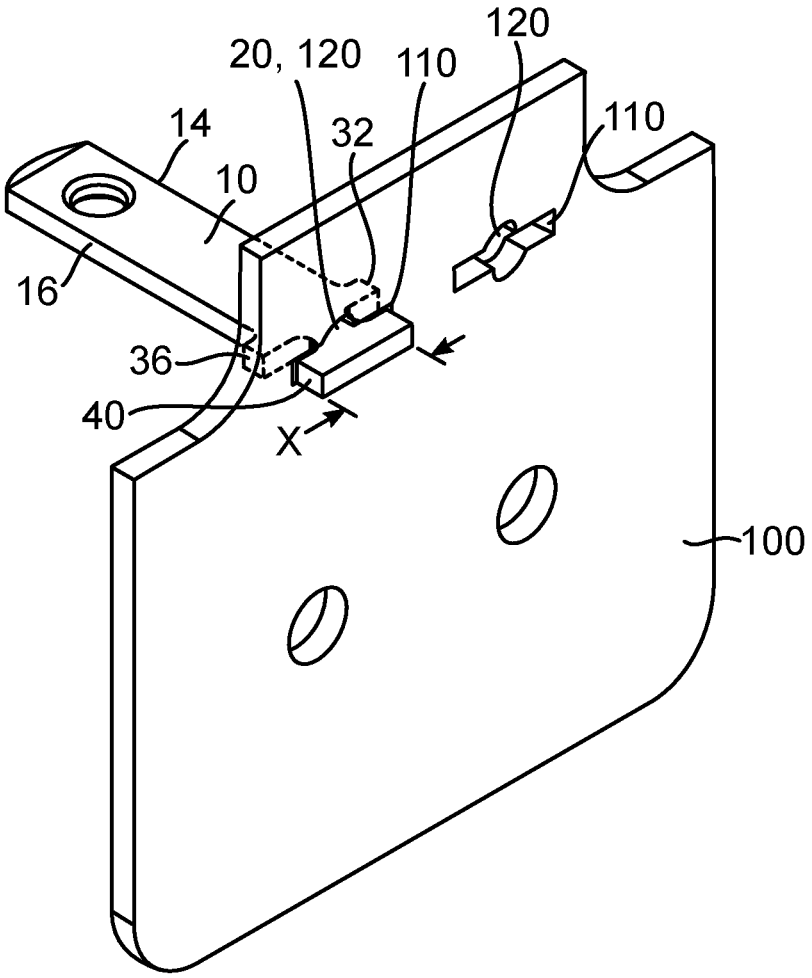
FIG. 6 illustrates a perspective view of an electrically-conductive blade extending through a receiving body of an electrical connector, in accordance with one embodiment.

FIG. 5 illustrates a perspective view of an electrically-conductive blade 10 and a receiving body 100 of an electrical connector 1, unassembled, in accordance with one embodiment. As described above, because the span X of the end portion 40 is less than the length L of the receiving body 100 hole 110 and the blade 10 width is more narrow than the width M of the hole 110, the end portion 40 fits into and through the hole 110. Thus, the blade 10 may be inserted by its end portion 40 at least partially through a receiving body 100 hole 110 until the neck 20 of the blade 10 is aligned with the hole 110, and thus aligned with the bulging portion 120 of the hole 110. That alignment is shown in the embodiment of FIG. 6, which illustrates a perspective view of the blade 10 extending through the receiving body 100 hole 110 of the electrical connector 1. In one embodiment and as described above, the alignment of the neck 20 of the blade 10 with the receiving body 100 hole 110 and its bulging portion 120 may be achieved by inserting the blade 10 into the hole 110 until the first shoulder 32 (or, in an embodiment, first shoulder 32 and second shoulder 36) contacts the receiving body 100 as shown, preventing further insertion.

Figure 7:
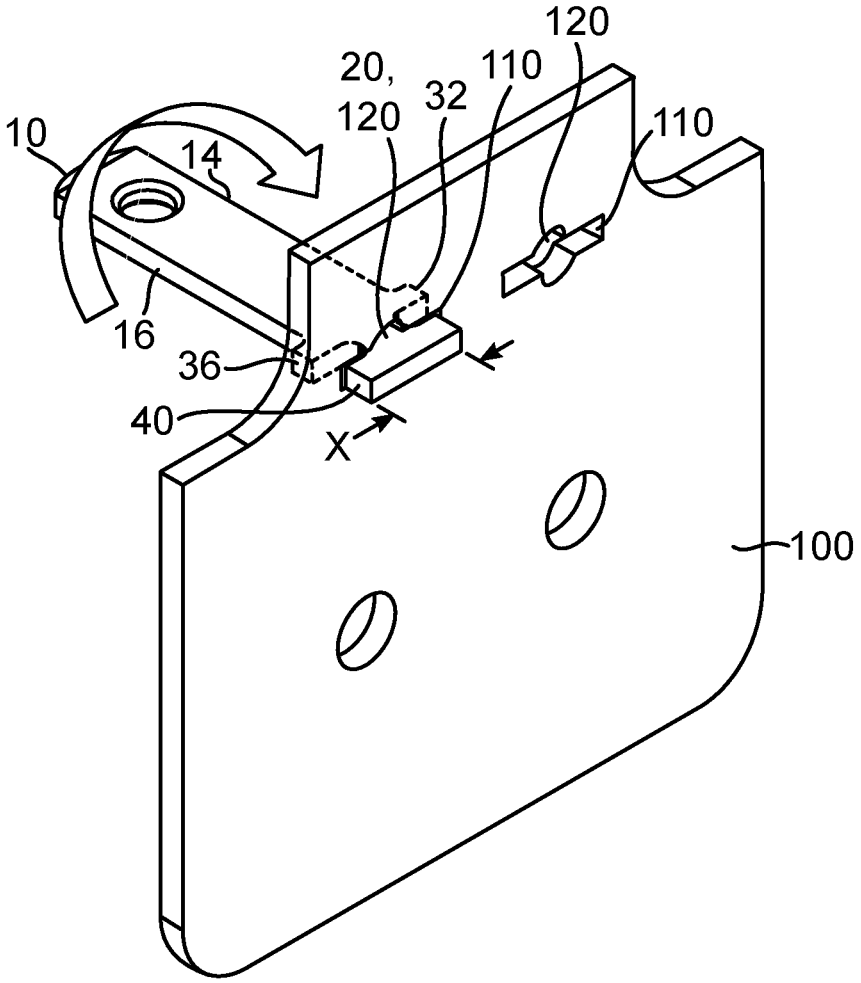
FIG. 7 illustrates a perspective view of an electrically-conductive blade extending through a receiving body of an electrical connector, in accordance with one embodiment.
Figure 8:
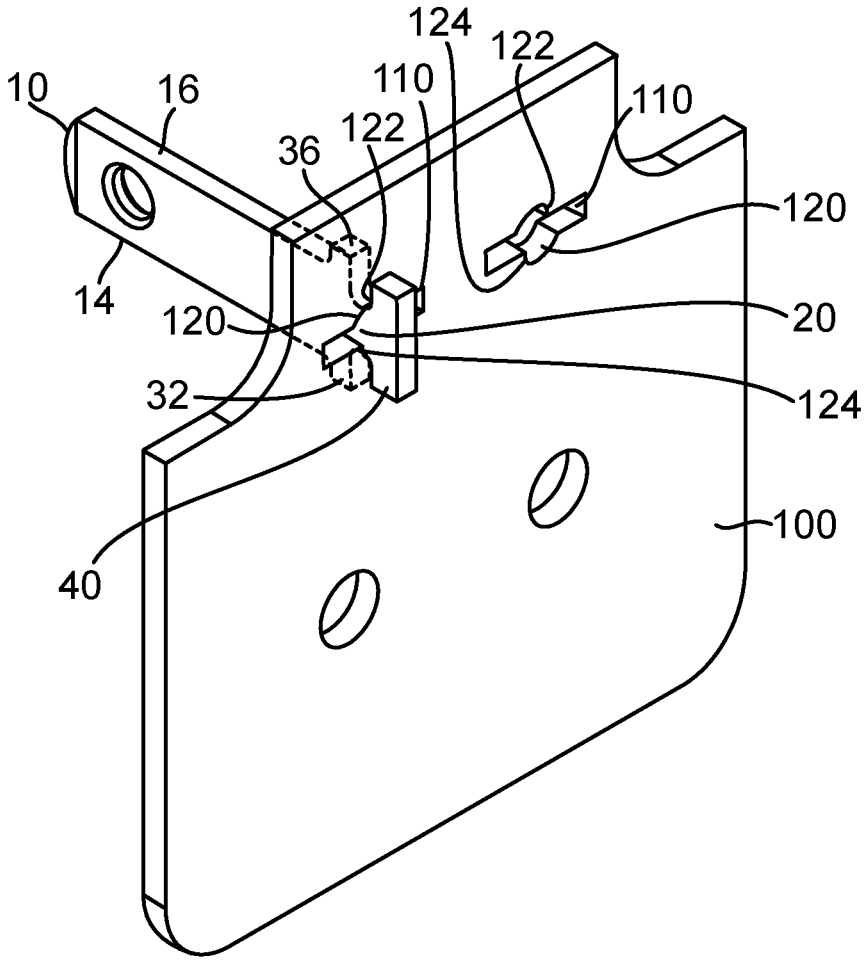
FIG. 8 illustrates a perspective view of an electrically-conductive blade after rotation while extended through a receiving body of an electrical connector, in accordance with one embodiment.
Figure 9:
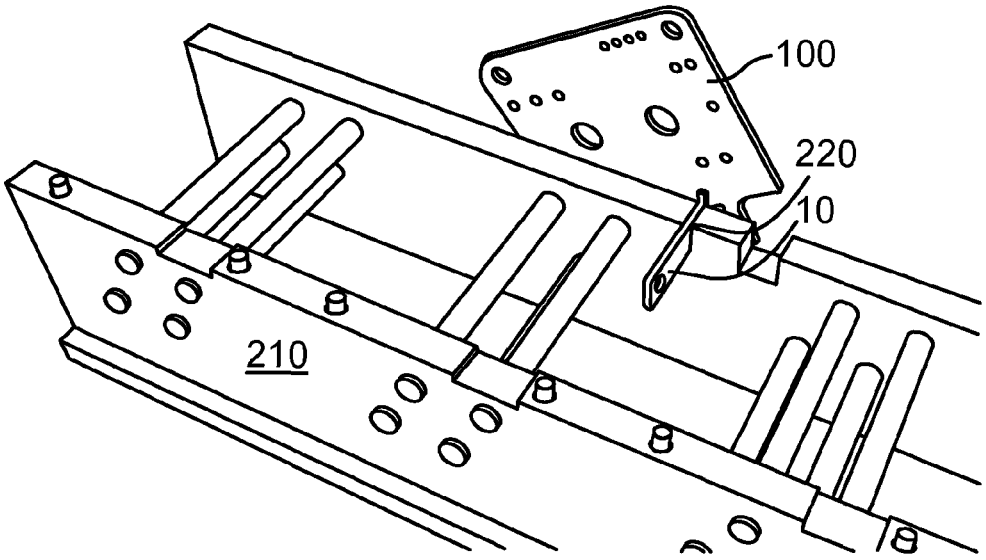
FIGS. 9-10 are perspective views of a blade fixture that may be used to rotate a blade with respect to a receiving body of an electrical connector, in accordance with an embodiment.
Figure 10:
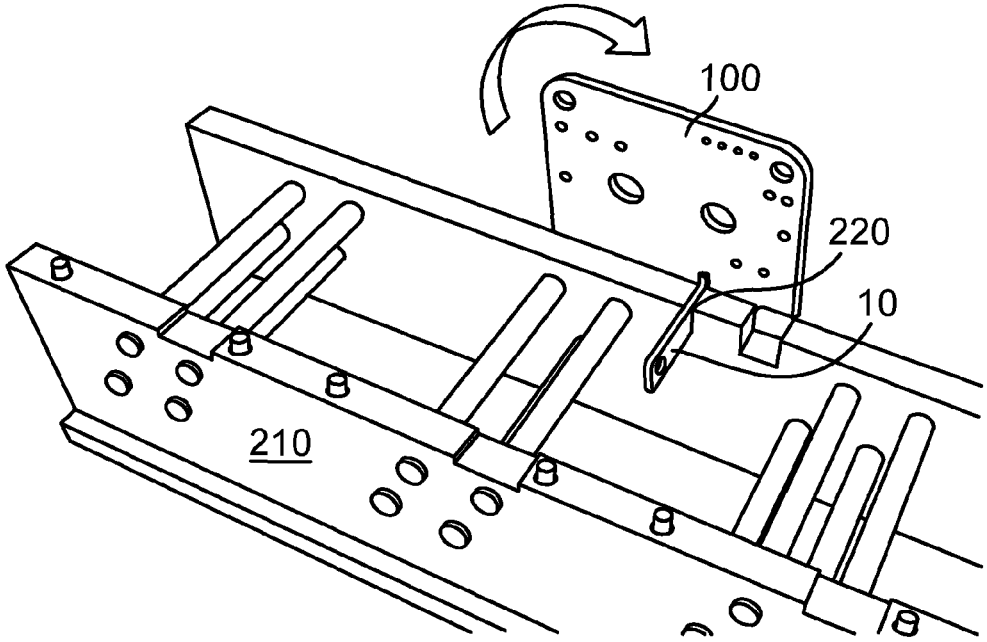

FIG. 7 illustrates a perspective view of an electrically-conductive blade 10 extending through a receiving body 100 hole 110 of an electrical connector 1, in accordance with one embodiment. This figure shows the same configuration as in FIG. 6, but with an arrow showing a direction in which the blade 10 may be rotated post-insertion into the receiving body 100 hole 110 such that its neck 20 rotates within the bulging portion 120 of the hole 110. FIG. 8 shows the blade 10 after being rotated to the extent that the neck 20 contacts at least one stop 122 (or two stops 122 and 124 in one embodiment) that the bulging portion 120 may comprise and is thereby stopped from further rotation. The process of rotating the blade 10 may be by any means desired, such as by hand, smooth jaw pliers, or by the blade fixture 210 shown in its perspective views in FIGS. 9-10. Thus, in an embodiment, the blade 10 may be rotated, at least in part, by first positioning the blade 10 within a slot 220 as shown in FIG. 9. The receiving body 100 may then be twisted, such as in the direction shown in FIG. 10, to rotate the blade 10 relative to the receiving body 100.

Figure 11:
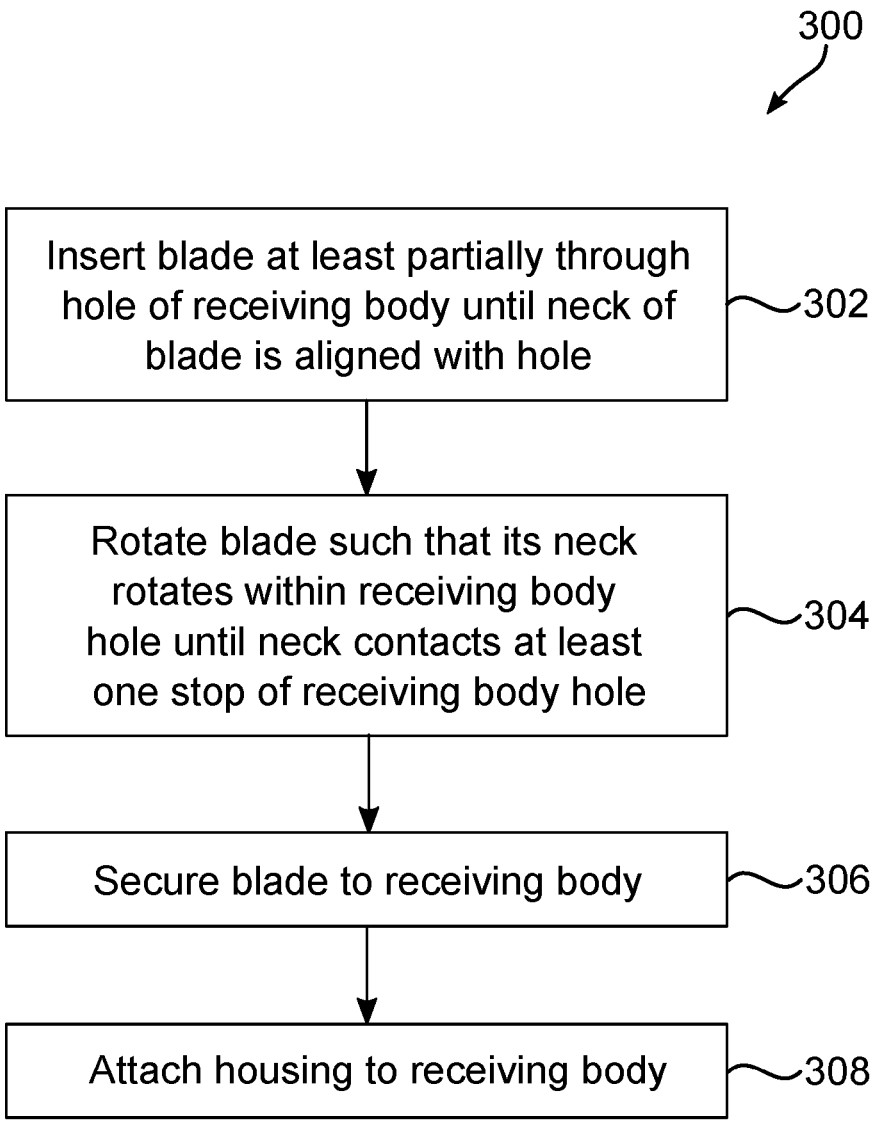
FIG. 11 is a flow chart of a method of assembling an electrical connector, in accordance with an embodiment.

FIG. 11 is a flow chart of a method 300 of assembling the electrical connector 1 described herein, in accordance with an embodiment. At 302 of the method, an electrically-conductive blade 10 may be inserted at least partially through a hole 110 of the receiving body 100 until the neck 20 of the blade 10 is aligned with the hole 110 bulging portion 120. In an embodiment, the neck 20 may be aligned by inserting the blade 10 at least partially through the receiving body 100 hole 110 until the shoulder 32 (or shoulders 32 and 36) of the blade contacts the receiving body 100, preventing further insertion. In an embodiment as described above, the receiving body 100 may be or include a PCB, and may in another embodiment also include, as shown in FIG. 12, a power supply 102 and 4-pin or other multi-pin connector 104. Embodiments of the method at 302 are described herein and above with respect to the figures, including FIGS. 5-6.

At 304, the blade 10 is rotated such that the neck 20 of the blade 10 rotates within the receiving body 100 hole 110, and more particularly within the bulging portion 120 of the hole 110 in an embodiment, until the neck 20 contacts at least one stop 122 (or both stops 122 and 124 in an embodiment including them) and is thereby stopped from further rotation. As described herein, the bulging portion 120 may include the stop 122 (or stops 122 and 124). The stop 122 (or stops 122 and 124) may be positioned to align the blade 10 as desired relative to the receiving body 100 and allow a desired rotation of the blade 10 within the hole 110. For example, that rotation may be 90 degrees, or may be another degree of rotation. Embodiments of the method at 304 are described herein and with respect to the figures, including FIGS. 7-8.

Figure 13:
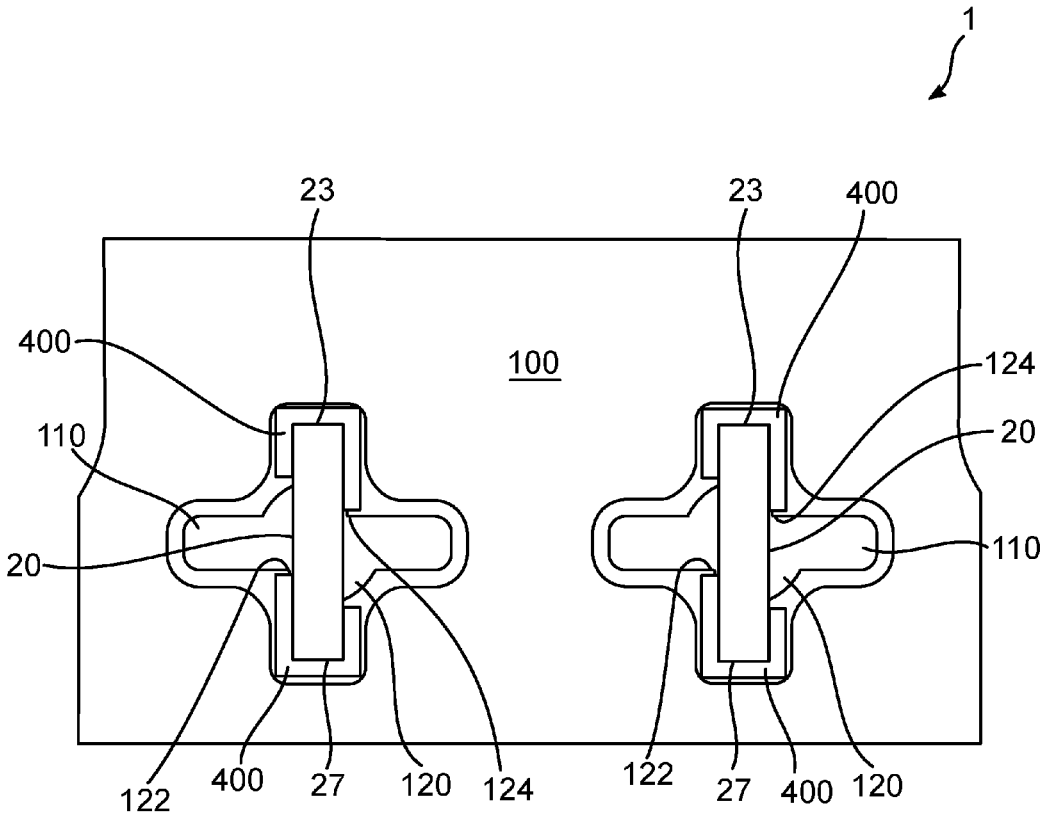
FIG. 13 illustrates a top view of part of an electrical connector showing solder on the top side of a receiving body attaching the blade thereto, in accordance with an embodiment.

At 306, the blade 10 may be secured to the receiving body 100, such as by soldering the blade 10 to the receiving body 100. If the receiving body 100 includes a PCB, the soldering of the blade 10 to the receiving body may include, in an embodiment, soldering the blade to only a top side (e.g. the side shown in FIG. 3) of the PCB. FIG. 13 illustrates a top view of part of the electrical connector 1 showing the solder 400 on the top side of a receiving body 100 (part of which is shown) including a PCB, securing the blades 10 to the PCB. In this embodiment, the solder may be applied at and around the bases 23 and 27 of the blade 10 notches (e.g., 22 and 26 in FIG. 2), respectively, at the top side of the PCB, if desired. The solder in this embodiment may not be applied to the bottom side (e.g., side shown in FIG. 4) of the PCB to avoid interference with assembly of the housing 200.

At 308, in an embodiment including the housing 200, the housing 200 may be secured to the rest of the electrical connector 1 by a desired means, such as snap-fit around the receiving body 100, by adhesive, or another means.

As described above, the electrical connector 1 may, in an embodiment, include more than one, such as two, blades 10 and receiving body 100 holes 110. In that embodiment, the process 300 at 302, 304, and 306 may be repeated for the second blade 10 and second receiving body 100 hole 110.

Having a configuration and method of attachment of the blade 10 to the receiving body 100 at the receiving body 100 hole 110 as described in the embodiments above may provide a sufficiently strong method of attachment that is quicker and more economical as compared to conventional means. In conventional electrical connectors, each blade may be molded to a plastic or rubber housing to provide a stable enough connection of the blade to meet stress safety standards. For example, to achieve UL safety compliance, direct plug-in products are subjected to various mechanical stress tests. These include the UL 1310 43.1-.2 Direct Plug-In Blade Securedness Test, which includes a 20 lb. axial pull on each blade 10 for two minutes, and the UL 1310 44.1-.3 Direct Plug-In Security of Input Contacts Test, which includes a 30 lb. axial push on each blade 10 for one minute. The severity of these tests lead electrical connector manufacturers to insert mold their blades to the plastic housing to secure the blades and distribute the applied forces. However, this molding may complicate the injection molding process for a housing and may add time and cost to production of the housing. Securing each blade 10 to the receiving body 100 of the electrical connector 1 as described in the embodiments herein may provide a means of attachment of the blade 10 that is economical and quicker. Additionally, the twist-lock configuration of the blade 10-receiving body 100 attachment, in which the end portion 40 and shoulder 32 (or shoulders 32 and 36) may provide resistance against pushing and pulling of the blade 10, sufficiently secure each blade 10 in the electrical connector 1 to pass the aforementioned UL safety axial pull and push tests. In that regard, the interlocking arrangement of the embodiments herein may distribute the force over a larger area of the electrical connector 1. For example, in an embodiment including the following parts, the metal of the blade 10 and fiberglass of the PCB may distribute the forces over a larger area to the housing 200.

In embodiments in which the shoulder 32 (or shoulders 32 and 36) extend past the first side 14 (or first side 14 and second side 16) of the blade 10, those configurations may provide further stability to the blade 10 when secured to the receiving body 100 as described herein. Those extended shoulders may provide increased stability by anchoring against forces on the blades 10 that are, for example, off-axis.

As described above, embodiments of each blade 10 of the electrical connector 1 may have a neck 20 that is defined by one notch or, as shown in the figures, two notches 22 and 26. An embodiment including only one such notch is shown in the blade 510 of FIG. 14. In this embodiment, the blade 510 has a neck 520 that is defined by only one notch 522 such that the neck 520 has a side 521 that is coincident with the first second side 516 of the blade 510. In this embodiment, the blade 10 has only one shoulder 532 adjacent to the first side 514 of the blade 510 such that the shoulder-span U of the blade 10 is the distance between the end 534 of the first shoulder 532 and the opposing second side 516 of the blade 510.

Figure 14:
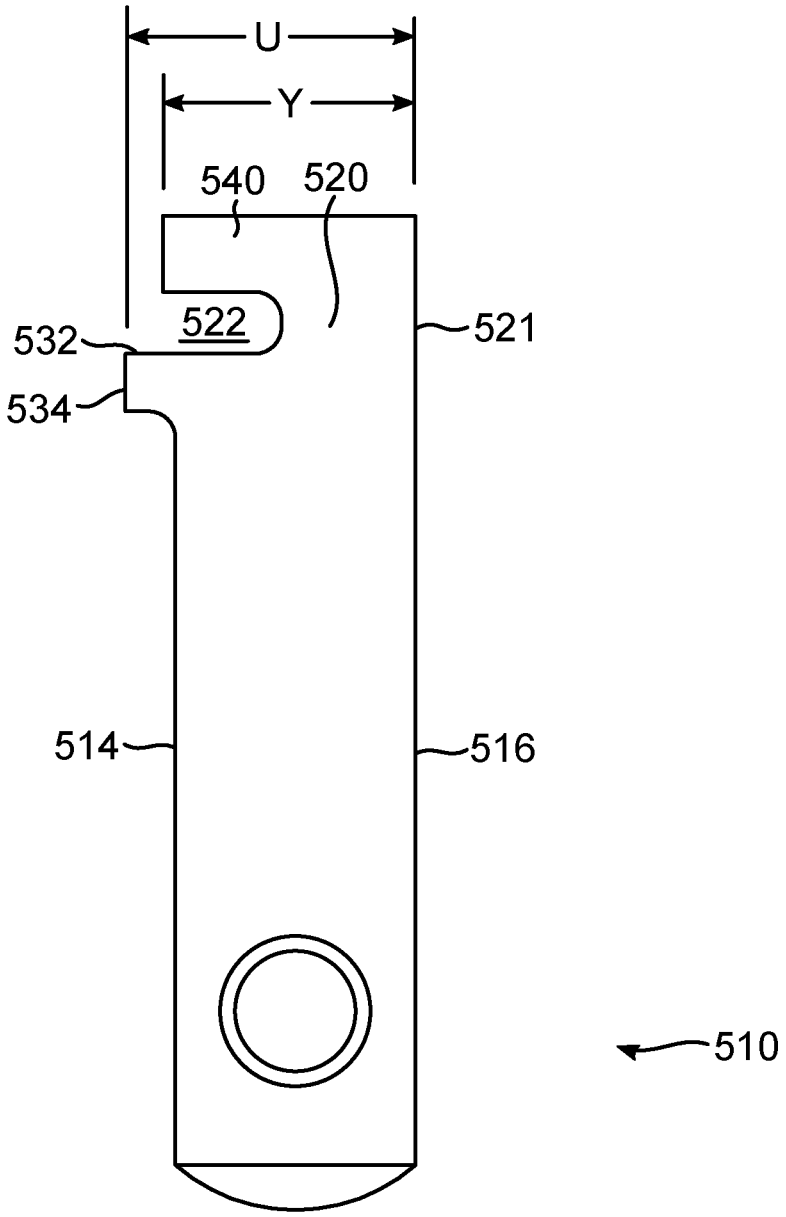
FIG. 14 illustrates a front view of an electrically-conductive blade for an electrical connector, in accordance with one embodiment.
Figure 15:
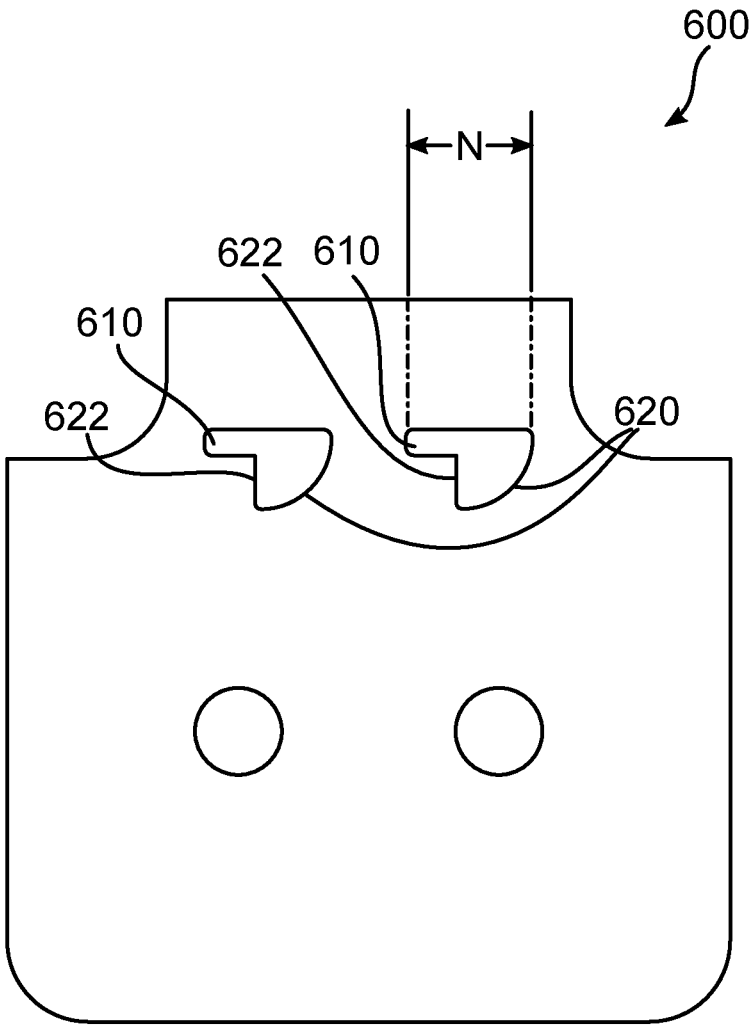
FIG. 15 illustrates a top view of a receiving body of an electrical connector, in accordance with an embodiment.

In the embodiment described with respect to FIG. 14, the electrical connector (e.g. 1) may include a receiving body having an appropriate hole to receive the blade 510. Such a receiving body 600 is shown in the embodiment of FIG. 15. The receiving body 600 includes at least one hole 610 in which the bulging portion 620 is positioned at least partially at the end of its length N so that when the blade 510 is inserted into the hole 610, the neck 520 of the blade 510 may align with the bulging portion 620. Additionally, the length N of the receiving body 600 hole 610 may be longer than the span Y of the end portion 540 of the blade 510 to allow the end portion 540 to be inserted through the hole 610. The blade 510 may rotate with its neck 520 aligned with the bulging portion 620 of the hole 610 until the neck 520 abuts the stop 622 of the bulging portion 620.

Figure 16:
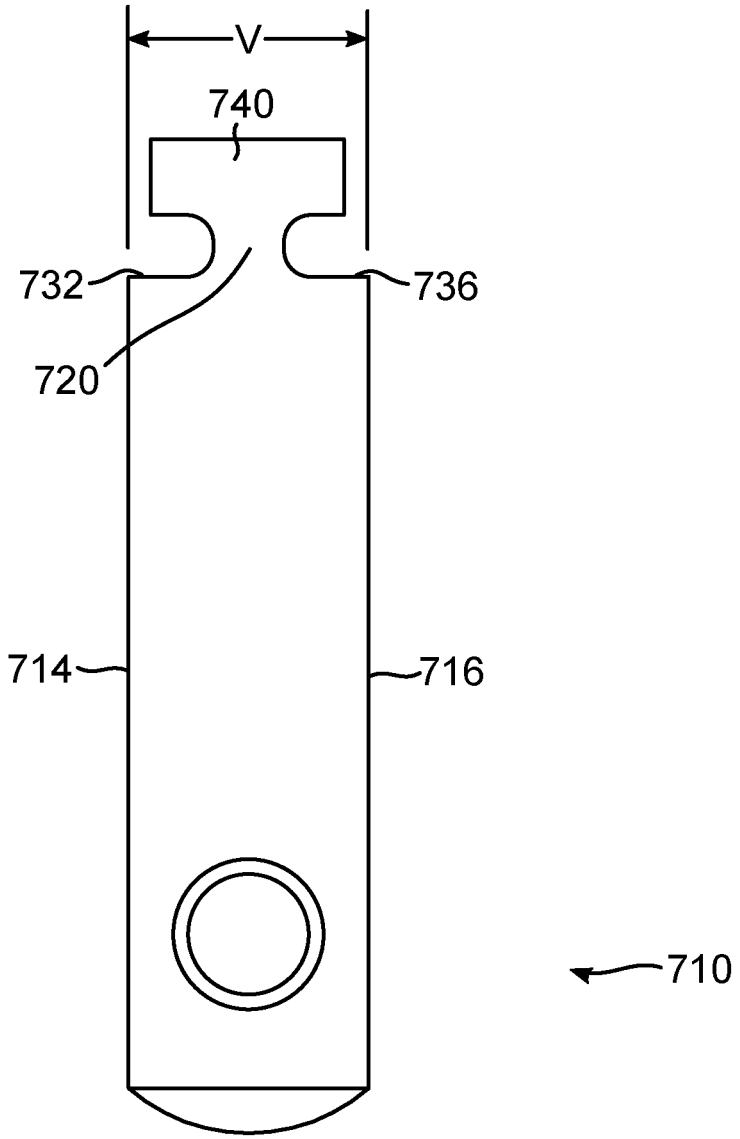
FIG. 16 illustrates a front view of an electrically-conductive blade for an electrical connector, in accordance with one embodiment.

Also as described above, embodiments of each blade 10 of the electrical connector 1 may have one shoulder 32 that does not extend from the blade 10 first side 14 or may have two shoulders 32 and 36 that, respectively, do not extend from the first side 14 and second side 16. FIG. 16 shows an embodiment of a blade 710 with two such shoulders 732 and 736 not extending, respectively, from the first side 714 and second side 716. In this embodiment, the shoulder-span V is greater than the length (e.g., L shown in FIGS. 3-4 receiving body 100) so that, during insertion of the blade 710 via its end portion 740 into an appropriate hole (e.g., 110) of a receiving body (e.g., 100) embodiment such as described herein, the shoulders 732 and 736 may block the blade 710 from further insertion through the receiving body hole when the shoulders 732 and 736 reach the receiving body. In that position, the neck 720 of the blade 710 may be aligned with the bulging portion (e.g., 120) of the hole of the receiving body.

The invention has been described with reference to embodiments. Modifications and alterations will occur to others upon reading and understanding the preceding detailed description. It is intended that the invention be construed as including all such modifications and alterations insofar as they come within the scope of the appended claims or the equivalents thereof.

Additionally, while certain aspects of conventional technologies have been discussed to facilitate disclosure of the invention, these technical aspects are in no way disclaimed, and it is contemplated that the claimed invention may encompass one or more of the conventional technical aspects discussed herein.

What is claimed is:

1. An electrical connector, comprising:

an electrically-conductive blade comprising:

a neck; and one or more shoulders, the one or more shoulders having a shoulder-span;

and a receiving body comprising a hole to receive at least a portion of the blade, the hole comprising:

a length that is less than the shoulder-span of the one or more shoulders of the blade; and a bulging portion to allow rotation of the blade when the blade extends through the hole of the receiving body such that the neck of the blade is aligned with the bulging portion, the bulging portion comprising at least one stop to limit the rotation of the blade.

2. The electrical connector of claim 1, wherein for the electrically-conductive blade, the neck is adjacent to the one or more shoulders such that the neck is said aligned with the bulging portion of the hole of the receiving body when the one or more shoulders are in contact with the receiving body.

3. The electrical connector of claim 2, the blade further comprising an end portion adjacent to the neck, the end portion having a span that is less than the length of the hole of the receiving body.

4. The electrical connector of claim 1, the at least one stop of the bulging portion of the receiving body hole being two stops.

5. The electrical connector of claim 4, the two stops to limit rotation of the blade by way of both being in contact with the blade.

6. The electrical connector of claim 1, the receiving body comprising a printed circuit board (PCB).

7. The electrical connector of claim 6, further comprising a power supply and a multi-pin connector.

8. The electrical connector of claim 1, further comprising:

a second said electrically-conductive blade; and a second said receiving body hole of the receiving body to said receive at least a portion of the second blade.

9. The electrical connector of claim 1, the blade further comprising a first side and a second side that opposes the first side, the neck of the blade defined by a first notch and a second notch, the first notch in the first side and the second notch in the second side.

10. The electrical connector of claim 9, the first notch and the second notch each comprising a curved base.

11. The electrical connector of claim 1, the blade further comprising a first side and a second side that opposes the first side, the one or more shoulders of the blade comprising a first shoulder and a second shoulder, the first shoulder adjacent to the first side, the second shoulder adjacent to the second side.

12. The electrical connector of claim 1, the blade further comprising a first side and a second side that opposes the first side, the one or more shoulders comprising a first shoulder extending from the first side.

13. The electrical connector of claim 12, the one or more shoulders further comprising a second shoulder, the second shoulder extending from the second side.

14. The electrical connector of claim 1, further comprising a housing to at least partially enclose and to secure thereto the receiving body.

15. The electrical connector of claim 1, wherein the bulging portion of the hole of the receiving body has an at least partially oval shape.

16. An electrical connector assembly method, comprising:

inserting an electrically-conductive blade at least partially through a hole of a receiving body until a neck of the blade is aligned with the hole;

rotating the blade such that the neck of the blade rotates within the receiving body hole until the neck contacts at least one stop of the receiving body hole and is thereby stopped from further rotation; and securing the blade to the receiving body.

17. The method of claim 16, wherein the inserting of the blade into the hole of the receiving body until the neck of the blade is aligned with the hole comprises:

inserting the blade at least partially through the hole of the receiving body until one or more shoulders of the blade contact the receiving body and thereby prevent further insertion of the blade.

18. The method of claim 16, wherein the rotating of the neck of the blade within the receiving body hole comprises:

rotating the neck within a bulging portion of the receiving body hole.

19. The method of claim 18, wherein the bulging portion within which the neck is rotated comprises the at least one stop of the receiving hole that said stops further rotation of the blade.

20. The electrical connector assembly method of claim 16, wherein the contacting by the blade neck of the at least one stop comprises contacting two stops.

21. The method of claim 16, wherein the inserting of the blade is into the hole of the receiving body that comprises a printed circuit board (PCB).

22. The method of claim 16, wherein the securing of the blade to the receiving body comprises soldering the blade to the receiving body.

23. The method of claim 22, wherein the inserting of the blade is into the hole of the receiving body that comprises a printed circuit board (PCB), the soldering of the blade to the receiving body comprising soldering the blade to only a top side of the PCB.

24. The electrical connector assembly method of claim 16, wherein the rotating of the blade comprises, at least in part, positioning the blade within a slot of a blade fixture and then rotating the blade relative to the receiving body by twisting the receiving body.

25. The method of claim 16, further comprising attaching a housing to a receiving body.

26. The method of claim 16, further comprising:

inserting a second electrically-conductive blade through a second hole of the receiving body until a second neck of the second blade is aligned with the second hole; and rotating the second blade such that the second neck of the second blade rotates with the second receiving body hole until the second neck contacts at least one second stop of the second receiving body hole and therefore stops further rotation.

27. An electrical connector, comprising:

two electrically-conductive blades, each blade comprising:

a first side and a second side that opposes the first side;

a neck defined by a first notch and a second notch, the first notch in the first side and the second notch in the second side, each of the first notch and the second notch comprising a curved base;

a first shoulder extending from the first side and having a first shoulder end;

a second shoulder extending from the second side and having a second shoulder end; and a shoulder-span that is a distance between the first shoulder end and the second shoulder end;

a printed circuit board (PCB) comprising two holes, each hole to receive therein at least a portion of one of the two blades, each hole being at least partially elongated with a hole length and having a bulging portion that is at least partially curved, the bulging portion to allow rotation of the neck of the one of the two blades when the PCB is said in receipt of the at least the portion of the one of the two blades, the bulging portion comprising a first stop and a second stop, the first stop and the second stop to limit the rotation of the neck of the one of the two blades, wherein the shoulder-span of each blade is greater than at least one of the lengths of the two holes of the PCB;

and a housing to secure to the PCB and to at least partially enclose the PCB.

* * * * *